United States Patent [19]

Osheroff

[11] 4,181,153

[45] Jan. 1, 1980

[54] FLUIDIC-AMPLIFIER DEVICE HAVING TUBE IN OUTLET CHANNEL

[75] Inventor: Gene W. Osheroff, Las Vegas, Nev.

[73] Assignee: McQuay-Perflex, Inc., Minneapolis, Minn.

[21] Appl. No.: 827,148

[22] Filed: Aug. 24, 1977

[51] Int. Cl.[2] ..... F15C 1/08

[52] U.S. Cl. ..... 137/838

[58] Field of Search ..... 137/805, 830, 835, 834, 137/838

[56] References Cited

U.S. PATENT DOCUMENTS 3,840,177 10/1974 Osheroff ..... 137/805 X 3,923,244 12/1975 Osheroff ..... 137/805 X

*Primary Examiner*—William R. Cline

*Attorney, Agent, or Firm*—Botney, Kay & Block

[57] ABSTRACT

The present invention involves the insertion and use of a tube in one of the outlet channels of a pure fluid bistable amplifier. The amplifier will function so long as the cross-sectional area of the tube is less than twenty percent (20%) of the cross-sectional area of the outlet in which it is mounted. The advantage of the tube is that velocity-pressure recovery can be as high as eighty percent (80%) as compared to forty eight percent (48%) without it.

2 Claims, 2 Drawing Figures

FLUIDIC-AMPLIFIER DEVICE HAVING TUBE IN OUTLET CHANNEL

Figure 1:
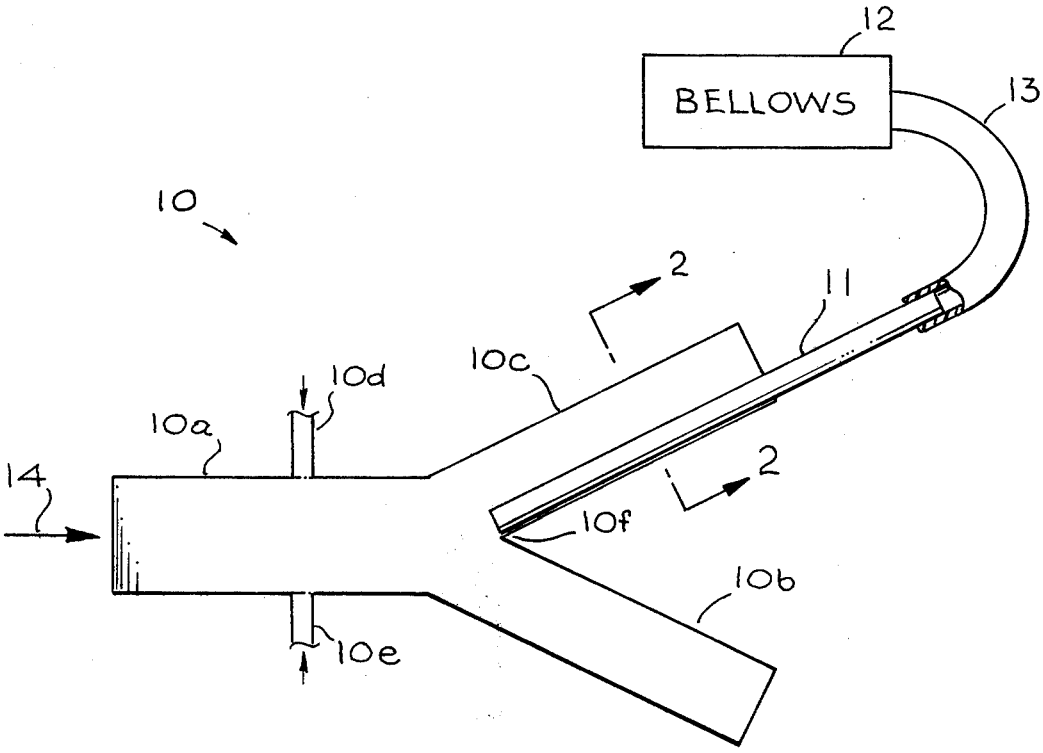

The present invention relates to pure fluid amplifiers in general, and more particularly relates to a pure fluid bistable amplifier that is modified to include a tube mounted in one of its outlet channels.

In U.S. Pat. No. 3840177 entitled "Fluidically-Controlled Air-Conditioning System," issued Oct. 8, 1974, to patentee Gene W. Osheroff, there is shown and described an air-conditioning system based on pure fluid principles in which, among other things, a bellows is coupled to one of the outlet channels of a bistable fluid amplifier, an air vent or opening being located in the wall of said channel. As air enters said one channel, the bellows inflates, as may be expected. However, when the incoming air is switched to the other of the amplifier's outlet channels, the bellows partially deflates, with the air leaving the bellows aspirating through the air vent. The trouble with this kind of arrangement is that the velocity-pressure recovery at the outlet channel is only about forty eight percent (48%) and, as is well known to those skilled in the art, this represents a substantial velocity-pressure loss between the input and output ends of the amplifier. A higher recovery ratio would certainly be a welcome and desirable improvement.

It is, therefore, an object of the present invention to improve the recovery factor of a pure fluid bistable amplifier.

It is another object of the present invention to provide the means by which an outlet channel of a pure fluid bistable amplifier can be coupled to an external device, such as a bellows, without incurring a major loss in velocity-pressure between the input and output ends of the amplifier.

Further objects and advantages of the invention, as well as its novel features, will be better understood from the following description considered in connection with the accompanying drawing in which an embodiment of the invention is illustrated by way of example. It is to be expressly understood, however, that the drawing is for the purpose of illustration and description only and is not intended as a definition of the limits of the invention.

Figure 2:
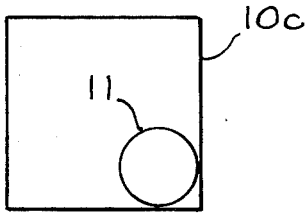

FIG. 1 is a schematic view of a pure fluid bistable amplifier showing a tube in one of its outlet channels in accordance with the present invention; and FIG. 2 is a cross-sectional view of the amplifier's outlet channel in which the tube is mounted, the view being taken along the line and in the direction of arrows 2—2.

For a more complete understanding of the details of the invention, reference is now made to the drawing wherein, in FIG. 1, an embodiment of the invention is shown to include a pure fluid amplifier of the bistable variety, generally designated 10. The amplifier includes an input channel 10*a*, a pair of output or outlet channels 10*b* and 10*c*, and a pair of control channels 10*d* and 10*e*. The junction of the outlet channels, commonly referred to as the splitter, is designated 10*f*. Outlet channel 10*b* is entirely vented to atmosphere. Outlet channel 10*c*, on the other hand, has a pipe or tube 11 mounted within it that extends from the splitter and along the channel to beyond, so that the tube protrudes from the outlet channel for a short distance. Tube 11 is then connected or coupled to an external device, such as a bellows 12, by means of a hose 13. A cross-sectional view of outlet channel 10*c* and tube 11 is illustrated in FIG. 2.

Tube 11 may be made of any suitable material, such as plastic or metal, and may have a variety of cross-sectional shapes such as circular, square, rectangular, etc., but, in order for the invention to function properly, it is necessary that the cross-sectional area of the tube not exceed twenty percent (20%) of the cross-sectional area of outlet channel 10*c*. Futhermore, it is preferable that the end of the tube adjacent splitter 10*f* be quite close to the splitter, an eighth of an inch or so, so as to more readily pick up the air stream directed down channel 10*c*. It is likewise preferable that the walls of the tube be as thin as possible, not only because it represents a saving of material, but also because it thereby tends to prevent or minimize discontinuities that lead to turbulence in the fluid flow.

In operation, air enters input channel 10*a*, as is indicated by arrow 14. When the air is directed down outlet channel 10*c*, a portion of the air stream is picked up and passes through tube 11 to bellows 12, which inflates as a result. However, when the air is directed into and through outlet channel 10*b*, the bellows deflates and by so doing, air from the bellows returns through tube 11 and aspirates out channel 10*b*. As previously mentioned, the important aspect of it all is that with the tube in the outlet channel, there is a marked improvement of the inlet pressure at the output end of the tube. More particularly, prior art recovery, at best, has been about forty eight percent (48%) but in the present invention, recovery as high as eighty percent (80%) can be attained. To explain this further for purposes of understanding, if the input pressure of the air at the mouth of input channel 10*a* is one pound per square inch (1.0 lb./sq. inc.), then in the prior art the pressure at the output end of outlet channel 10*c* would be reduced to forty eight hundredths of a pound per square inch (0.48 lb./sq. in.) whereas in the present invention, the pressure at the output end of tube 11 is eighty hundredths of a pound per square inch (0.80 lb./sq. in.), an obvious and significant improvement.

Although a particular arrangement of the invention has been illustrated and described hereinabove, it has been by way of example and it is not intended that the invention be limited thereto. Accordingly, the invention should be considered to include any and all modifications, alterations or equivalent arrangements falling within the scope of the annexed claims.

Having thus described the invention, what is claimed is:

1. A pure-fluid device comprising: a pure-fluid bistable amplifier having an input channel, a pair of diverging outlet channels forming a splitter there between and a pair of control channels, said outlet channels respectively having rectangular-shaped cross-sections; and a velocity-pressure recovery tube of circular cross-section mounted in one of said outlet channels along and contiguous to the wall thereof that is adjacent the splitter, the mouth of said tube being positioned adjacent the apex of said splitter and the cross-sectional area of said tube being not more than twenty percent of the cross-sectional area of the outlet channel in which it is mounted.

2. The pure-fluid device defined in claim 1 wherein the cross-sectional areas of said outlet channels are substantially square-shaped.

* * * * *